United States Patent [19]

Campin

[11] Patent Number: 4,566,844

[45] Date of Patent: Jan. 28, 1986

[54] BUCKET FOR MATERIAL

[76] Inventor: Joseph C. Campin, Le Tertre, Cidex 541bis, Theillay F-41300 Salbris, France

[21] Appl. No.: 560,363

[22] Filed: Dec. 12, 1983

[30] Foreign Application Priority Data

Dec. 21, 1982 [GB] United Kingdom ..... 8236292

[51] Int. Cl.[4] ..... F02F 3/76

[52] U.S. Cl. ..... 414/726; 37/117.5

[58] Field of Search ..... 414/726, 722, 685, 912; 37/103, 117.5, 118 R, 118 A, DIG. 3

[56] References Cited

U.S. PATENT DOCUMENTS

| | | | |
|---|---|---|---|
| 2,679,326 | 5/1954 | Isaksen | 414/726 |
| 3,252,606 | 5/1966 | Pryor | 414/726 |
| 3,461,968 | 8/1969 | Longley | 37/117.5 |
| 3,975,844 | 8/1976 | Olson | 37/DIG. 3 |

FOREIGN PATENT DOCUMENTS

| | | | |
|---|---|---|---|
| 133937 | 8/1982 | Japan | 37/117.5 |

*Primary Examiner*—Douglas Hart

[57] ABSTRACT

In a loader bucket having a back member pivotable on a boom assembly which is pivotable on a tractor and a front member pivotable on the back member, power-operated means for effecting relative pivoting of the members have comprised two hydraulic piston-and-cylinder assemblies disposed at the respective ends of the bucket and fed from a common pressure line so as to work in unison. However, when gripping asymmetrical loads between the members the front member is distorted due to the pressure liquid taking the path of least resistance and thus permitting unequal extension of the piston-and-cylinder assemblies. This problem is minimized by employing a single, central hydraulic piston-and-cylinder assembly connected between a point on the back member and a lug fixed to a torsion bar which interconnects the ends of the front member along its pivot axis. The gripping of asymmetrical loads then twists the torsion bar within its elastic limit.

7 Claims, 3 Drawing Figures

BUCKET FOR MATERIAL

BACKGROUND OF THE INVENTION

This invention relates to a bucket, for material handling apparatus of the kind including a bucket-supporting boom assembly disposed on a vehicle and projecting beyond one end thereof which assembly is so attached to the vehicle as to be pivotable relative thereto by power-operated means, said bucket being of the type having a back member adapted to be so mounted on the projecting end of the boom assembly as to be pivotable relative thereto by power operated means and a front member so mounted on the back member as to be pivotable relative thereto by power-operated means. The back member resembles a bulldozer blade, and the front member comprises two end plates welded to a bottom plate and resembles a backless bucket. The boom assembly may comprise twin booms disposed at opposite sides of the vehicle, in which case ground-engaging shoes may be provided on the projecting ends of the booms. Material handling apparatus comprising such a bucket and twin boom arrangement is disclosed in U.S. Pat. No. 2,812,595. Alternatively, the boom assembly may comprise a single boom arrangement. Said arrangement may be articulated, for example may comprise a first arm so attached to the vehicle as to be pivotable relative thereto by power-operated means and a second arm so attached to the free end of the first arm as to be pivotable relative thereto by power-operated means, the back member of the bucket being adapted to be mounted on the projecting end of the second arm.

Where a bucket of the type referred to is of considerable width, for example as shown in U.S. Pat. No. 2,812,595 of substantially the same width as the vehicle, it can perform in known manner a very large variety of operations including bulldozing and the like. The power-operated means for pivoting the front member relative to the back member have hitherto comprised two hydraulic piston-and-cylinder assemblies disposed at the respective ends of the bucket and fed from a common pressure line so as to work in unison. However, where an asymmetrical load has to be gripped between the front member and the back member, this arrangement suffers from the disadvantage that the front member is distorted due to the pressure liquid taking the path of least resistance and thus permitting unequal extension of said piston-and-cylinder assemblies.

The object of the present invention is to minimise the aforesaid disadvantage and at the same time reduce the cost of the bucket.

SUMMARY OF THE INVENTION

According to the invention, in a bucket of the type referred to, for material handling apparatus of the kind referred to, the power-operated means for pivoting the front member relative to the back member comprise a single, central hydraulic piston-and-cylinder assembly connected between a point on the back member and a lug fixed to a torsion bar which interconnects the ends of the front member along the pivot axis thereof.

BRIEF DESCRIPTION OF DRAWINGS

A preferred embodiment of the invention will now be described, by way of example only, with reference to the accompanying drawings of which.

DESCRIPTION OF PREFERRED EMBODIMENT

Figure 1:
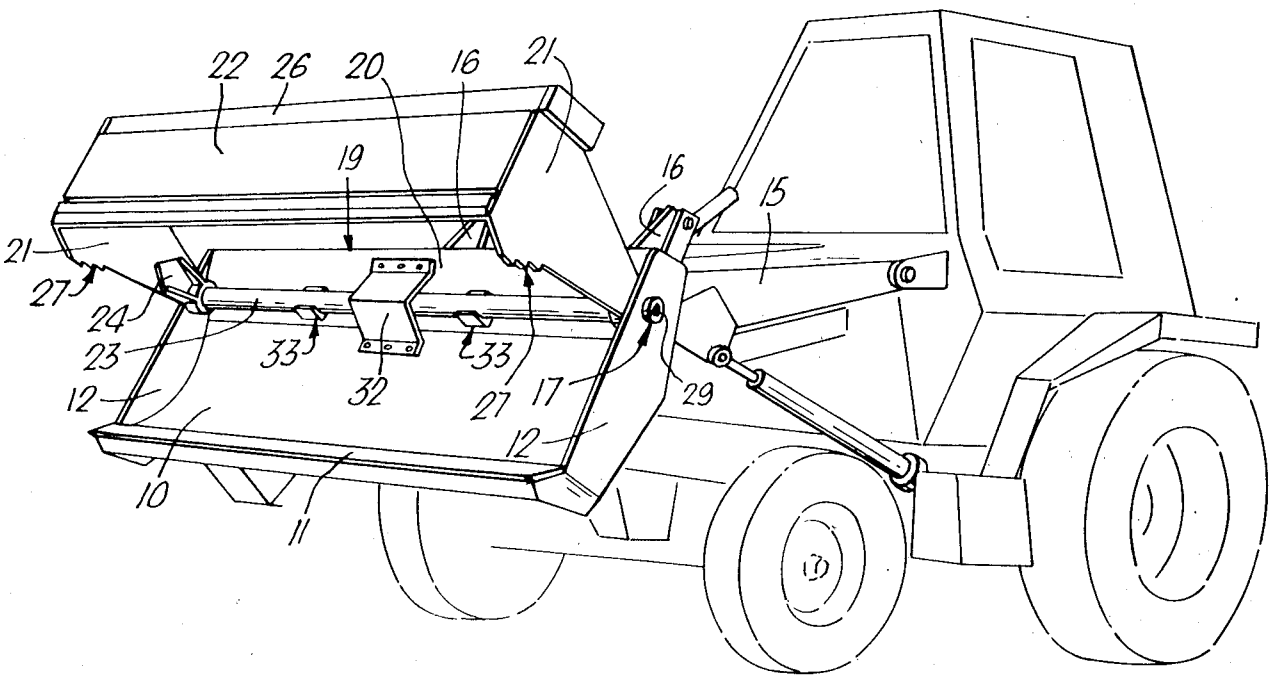
FIG. 1 is a perspective view of a bucket according to the invention mounted on a tractor, the bucket being partially raised with its back member substantially upright and its front member pivoted fully away from its back member.

Referring now to the drawings, a bucket for twin-boom material handling apparatus of the kind referred to includes a back member comprising a rectangular back plate 10 which is curved about a transverse axis and has a blade 11 secured along its lower edge, two end plates 12 welded to the back plate 10, a pair of lugs 13 welded to the rear of the back plate 10 centrally and adjacent the lower edge thereof, two laterally-spaced pairs of vertical ribs 14 welded to the rear of the back plate 10 and each adapted to have the projecting end of one of the twin booms 15 pivotally connected between their lower ends and one of two power-operated linkages 16 for pivoting the back member relative to the booms 15 pivotally connected between their middle regions, and full bearings 17 carried by the respective end plates 12 in axial alignment with each other for pivotally mounting a front member of the bucket. A ground-engaging shoe 18 is welded to the lower ends of each pair of ribs 14. The upper extremities of the end plates 12 and of the ribs 14 are interconnected by a transverse channel section 19 with unequal flanges, the longer flange 20 of which is aligned with but spaced from the upper edge of the back plate 10 on that side of the common axis of the full bearings 17 opposite said edge.

The front member of the bucket comprises two roughly triangular end plates 21, a rectangular bottom plate 22 welded between the bases of the end plates 21, and a tubular torsion bar 23 welded between cast bearing brackets 24 secured to the apices of the end plates 21. The bottom plate 22 is stiffened by welding to its upper face another plate 25 of approximately the same size and of shallow inverted V-shape in fore-and-aft cross section. A blade 26 is secured to the front edge of the bottom plate 22, and the lower parts of the rear edges of the end plates 21 have coarse-pitched gripping teeth 27 formed on them. A pair of lugs 28 is welded to the torsion bar 23 centrally thereof and substantially diametrically opposite the bottom plate 22.

Figure 2:
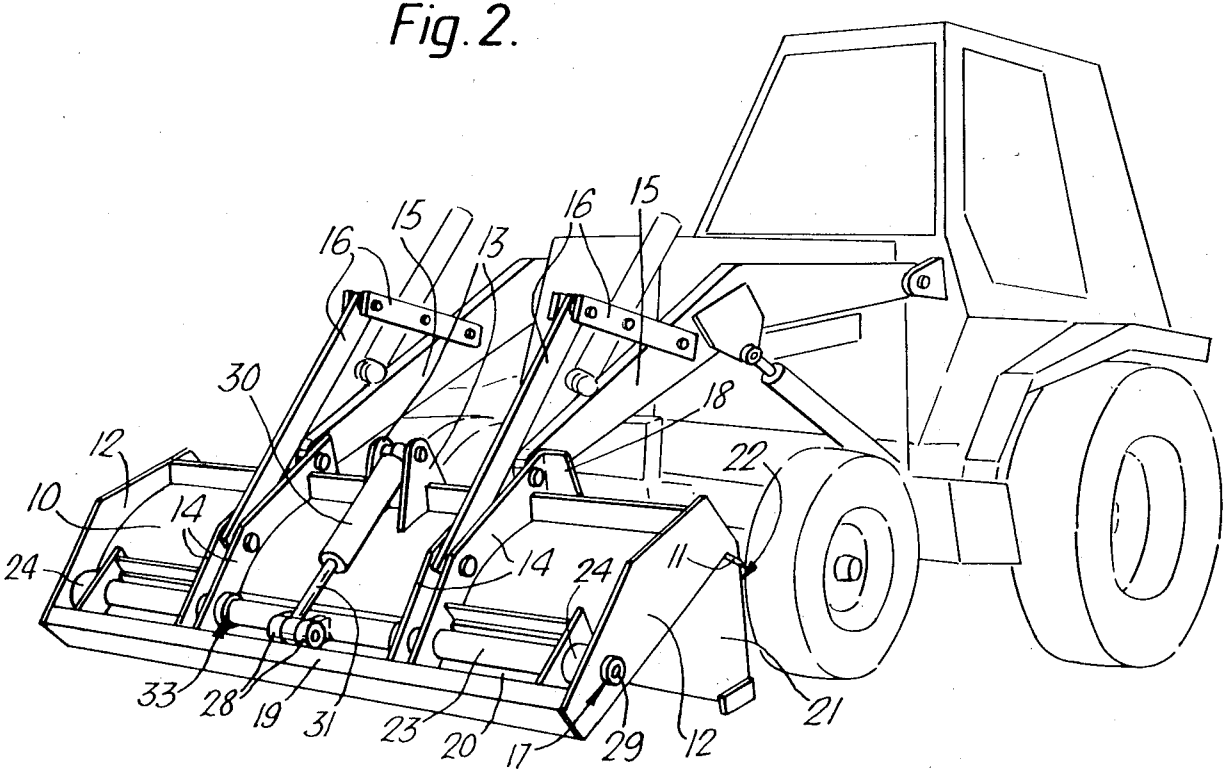
FIG. 2 is another perspective view of the bucket and tractor from substantially the same position, the bucket being lowered to the ground with its back member pivoted fully forwards to show the rear thereof and its front member in contact with its back member.
Figure 3:
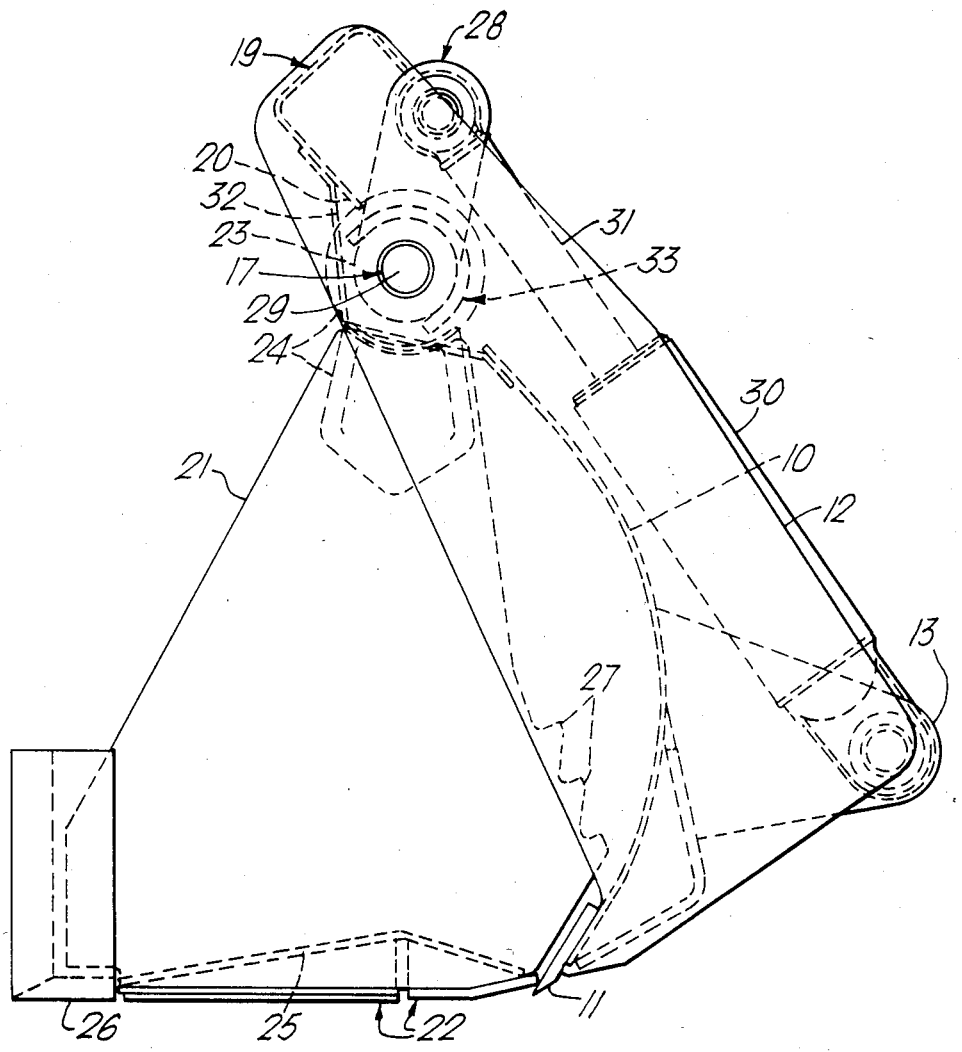
FIG. 3 is a side elevation on a larger scale of the bucket with its front member in contact with its back member.

The front member is mounted on the back member by means of two pivot pins 29 each of which passes through one of the full bearings 17 in the back member and through bearings (not shown) housed in one of the bearing brackets 24 of the front member, whereby the torsion bar 23 occupies with clearance the space between the back plate 10 and the longer flange 20 of the transverse channel section 19 of the back member. A hydraulic cylinder 30 is pivotally connected between the pair of lugs 13 on the back member and its piston rod 31 is pivotally connected between the pair of lugs 28 on the torsion bar 23, the cylinder 30 being disposed wholly behind the back member. After assembly of the back and front members of the bucket, a plate 32 of shallow V-shaped cross-section is bolted between the back plate 10 and the longer flange 20 of the transverse channel section 19, in front of the middle region of the torsion bar 23 where its pair of lugs 28 is welded, to protect the piston rod 31 as much as possible from dirt passing through the clearance between the torsion bar 23 and the space which it occupies in the back member. The relative disposition of the parts is such that when the piston rod 31 is extended to pivot the front member into contact with the back member as shown in FIGS. 2 and 3, the end plates 12 of the back member overlap the end plates 21 of the front member on the outside thereof. Retraction of the piston rod 31 pivots the front member forwardly and upwardly through an angle of, say, 90° away from the member as shown is FIG. 1. The use of a single hydraulic piston-and-cylinder assembly to actuate the front member reduces the cost of the bucket.

To support the torsion bar 23 against deflection under load in view of its considerable length, it is journalled in two plain half-bearings 33 of high carbon steel each of which is welded to the inner rib of one of the pairs of ribs 14 on the back member. These half-bearings 33 do not complicate the assembly of the bucket.

In operation, the gripping of asymmetrical loads between the front member and the back member causes twisting of the torsion bar 23 within its elastic limit and thus minimises distortion of the rest of the front member.

It will be understood that although the preferred embodiment of the invention has been described with reference to twin-boom material handling apparatus, the invention is equally well applicable to material handling apparatus having a single boom arrangement.

I claim:

1. A bucket, for material handling apparatus including a bucket-supporting boom assembly disposed on a vehicle and projecting beyond one end thereof which assembly is so attached to the vehicle as to be pivotable relative thereto by power-operated means, said bucket having a back member adapted to be so mounted on the projecting end of the boom assembly as to be pivotable relative thereto by second power-operated means and a front member so mounted on the back member as to be moveable relative thereto about a pivot axis by third power-operated means which comprise a single, central hydraulic piston-and-cylinder assembly connected between a point on the back member and a lug fixed to a torsion bar which is connected only to the ends of the front member on the pivot axis thereof.

2. A bucket according to claim 1, wherein the torsion bar is supported against deflection at a plurality of points between its ends in bearings secured to the back member.

3. A bucket according to claim 2, wherein the back member has fixed to it two laterally-spaced pairs of vertical ribs which are adapted to be pivotally connected to respective twin booms constituting the boom assembly, said two pairs of ribs having fixed to them respective ones of the bearings for supporting the torsion bar against deflection.

4. A bucket according to claim 3, wherein the two pairs of ribs also have fixed to them respective ground-engaging shoes.

5. A bucket according to claim 2, claim 3 or claim 4, wherein the bearings are formed as half-bearings for ease of assembly of the bucket.

6. A bucket according to claim 2, claim 3 or claim 4, wherein the torsion bar is tubular.

7. A bucket according to claim 5, wherein the torsion bar is tubular.

* * * * *